US005308518A

United States Patent [19]

Habeeb et al.

[11] Patent Number: 5,308,518

[45] Date of Patent: May 3, 1994

[54] LUBRICANT COMPOSITION CONTAINING ALKOXYLATED AMINE SALT OF A DIHYDROCARBYLDITHIOBENZOIC ACID

[75] Inventors: Jacob J. Habeeb; Morton Beltzer, both of Westfield, N.J.

[73] Assignee: Exxon Research and Engineering Company, Florham Park, N.J.

[21] Appl. No.: 21,509

[22] Filed: Feb. 22, 1993

[51] Int. Cl.[5] ..... C10M 135/12

[52] U.S. Cl. ..... 252/33.6; 252/34

[58] Field of Search ..... 252/32.7 R, 33.6

[56] References Cited

U.S. PATENT DOCUMENTS 4,382,006 5/1983 Horodysky ..... 252/33.6

5,076,945 12/1991 Habeeb et al. ..... 252/47.5

*Primary Examiner*—Prince Willis, Jr.

*Assistant Examiner*—Edna Wong

*Attorney, Agent, or Firm*—James H. Takemoto

[57] ABSTRACT

A lubricating oil composition having improved antiwear and fuel economy properties which comprises a lubricating oil basestock and an alkoxylated amine salt of a dihydrocarbyldithiobenzoic acid of the formula

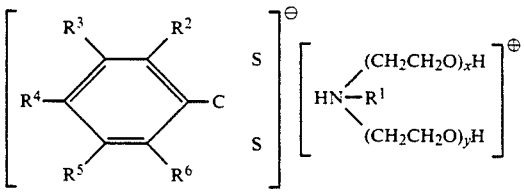

(I)

where $R^1$ is a hydrocarbyl group having from 2 to 22 carbon atoms, $R^2$, $R^3$, $R^4$, $R^5$ and $R^6$ are each independently hydrogen, a hydrocarbyl group containing from 1 to 24 carbon atoms or a hydroxy group with the proviso that at least one of $R^2$ to $R^5$ is a hydrocarbyl group, and x and y are each independently integers of from 1 to 15 with the proviso that the sum of x + y is from 2 to 20.

8 Claims, No Drawings

LUBRICANT COMPOSITION CONTAINING ALKOXYLATED AMINE SALT OF A DIHYDROCARBYLDITHIOBENZOIC ACID

BACKGROUND OF THE INVENTION

1. Field of the Invention

This invention relates to a lubricant composition containing an alkoxylated amine salt of a dihydrocarbyldithiobenzoic acid and its use to improve friction reduction in an internal combustion engine.

2. Description of the Related Art p In order to protect internal combustion engines from wear, engine lubricating oils have been provided with antiwear and antioxidant additives. The primary oil additive for the past 40 years for providing antiwear and antioxidant properties has been zinc dialkyldithiophosphate (ZDDP). U.S. Pat. No. 5,076,945 discloses a lubricating oil composition containing an amine salt of a dithiobenzoic acid. The amines used to prepare salts are long chain hydrocarbyl amines.

Oil additive packages containing ZDDP have environmental drawbacks. ZDDP adds to engine deposits which can lead to increased oil consumption and emissions. Moreover, ZDDP is not ash-free and contain phosphorus which poisons the catalytic converters of cars. This results in increased emissions. Various ashless oil additive packages have been developed recently due to such environmental concerns.

It would be desirable to have a lubricating oil additive which provides excellent antiwear, fuel economy and environmentally beneficial (less fuel, less phosphorus, i.e., less exhaust emissions) properties.

SUMMARY OF THE INVENTION

This invention relates to alkoxylated amine salts of dihydrocarbyldithiobenzoic in lubricating oils to improve friction reduction in an internal combustion engine thereby improving economy, and additionally providing antiwear and antioxidancy properties. The lubricating oil composition comprises a major amount of a lubricating oil basestock and a minor amount of an alkoxylated amine salt of a dihydrocarbyldithiobenzoic acid, said salt having the formula

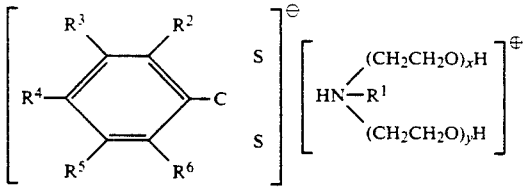

(I)

where $R^1$ is a hydrocarbyl group having from 2 to 22 carbon atoms, $R^2$, $R^3$, $R^4$, $R^5$ and $R^6$ are each independently hydrogen, a hydrocarbyl group containing from 1 to 24 carbon atoms or a hydroxy group with the proviso that at least one of $R^2$ to $R^5$ is a hydrocarbyl group, and x and y are each independently integers of from 1 to 15 with the proviso that the sum of $x+y$ is from 2 to 20. In another embodiment, there is provided a method for improving friction reduction in an internal combustion engine which comprises operating the engine with a lubricating oil containing an amount effective to improve friction reduction of an amine salt of the formula (I).

DETAILED DESCRIPTION OF THE INVENTION

In the lubricating oil composition of the present invention, the lubricating oil will contain a major amount of a lubricating oil basestock. The lubricating oil basestock are well known in the art and can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal and shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein he terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source of synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The amine salts of dihydrocarbyldithiophosphoric acids are prepared from the reaction of alkoxylated, preferably propoxylated or ethoxylated, especially preferably ethoxylated amines with dihydrocarbyldithiobenzoic acids. Preferred ethoxylated amines used to prepare amine salts have the formula

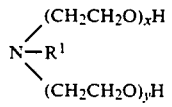

where $R^1$ is a hydrocarbyl group of from 2 to 22 carbon atoms, preferably 6 to 18 carbon atoms. The hydrocarbyl groups include aliphatic (alkyl or alkenyl) groups which may be substituted with hydroxy, mercapto, amino and the like, and hydrocarbyl group may be interrupted by oxygen, nitrogen, or sulfur. The sum of x+y is preferably 2 to 15. Ethoxylated and/or propoxylated amines are commercially available from Sherex Chemicals under the trade name Varonic® and from Akzo Corporation under the trade names Ethomeen®, Ethoduomeen® and Propomeen®. Examples of preferred amines containing from 2 to 15 ethoxy groups include ethoxylated (5) cocoalkylamine, ethoxylate (2) tallowalkylamine, ethoxylated (15) cocoalkylamine, ethoxylated (5) soyaalkylamine, and ethoxylated (10) stearylamine.

Preferred dihydrocarbyldithiobenzoic acids used to reacted with alkoxylated amines have the formula

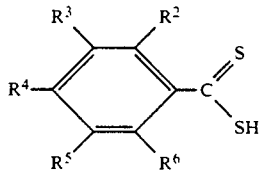

where $R^2$ to $R^6$ are each preferably hydrogen; a hydrocarbyl group containing from 1 to 18 carbon atoms or a hydroxy group with the proviso that at least one of $R^2$ to $R^6$ is a hydrocarbyl, preferably an alkyl group containing 1 to 18 carbon atoms, more preferably 1 to 6 carbon atoms. $R^3$and $R^5$ are most preferably t-butyl groups and $R^4$ is most preferably hydroxy. The hydrocarbyl groups include aliphatic (alkyl or alkenyl) and alicyclic groups which may be substituted with hydroxy, mercapto, amino and the like and the hydrocarbyl group may be interrupted by oxygen, nitrogen or sulfur.

Dithiobenzoic acids may be prepared from a phenol according to the following method. A phenol of the formula

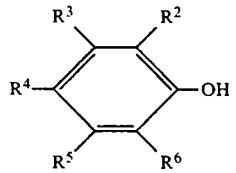

is dissolved in a solvent such as dimethylsulfoxide and treated under nitrogen with potassium hydroxide dissolved in a minimum of water. Carbon disulfide is added under nitrogen to this mixture which is maintained at about room temperature. The resulting reaction mixture is heated at between 25° to 100° C. for 1-3 hours and then added to an acidified water solution. The resulting dithiobenzoic acid can be isolated by solvent extraction using, e.g. ether and the solvent evaporated.

The amine salts are prepared by methods known to those skilled in the art. Approximately equimolar amounts of alkoxylated amine and dihydrocarbyldithiobenzoic acid are mixed together in an acid/base neutralization reaction. The amounts of acid or base may be varied to achieve the desired acid/base balance of the final amine salt.

The lubricant oil composition according to the invention comprises a major amount of lubricating oil basestock and an amount effective to increase fuel economy of amine salt. Typically, the amount of amine salt will be from about 0.1 wt. % to about 5 wt. %, based on oil basestock. Preferably, the amount of amine salt is form about 0.5 wt. % to about 2 wt. %.

If desired, other additives known in the art may be added to the lubricating oil basestock. Such additives include dispersants, other antiwear agents, other antioxidants, corrosion inhibitors, detergents, pour point depressants, extreme pressure additives, viscosity index improvers, friction modifiers, and the like. These additives are typically disclosed, for example in "Lubricant Additives" by C. V. Smalhear and R. Kennedy Smith, 1967, pp. 1-11 and in U.S. Pat. No. 4,105,571, the disclosures of which are incorporated herein by reference.

The lubricating oil composition of the invention is further illustrated by the following examples which also illustrate a preferred embodiment.

EXAMPLE 1

140 g of ethoxylated (5) cocoalkylamine was placed in a 3-neck round bottom flask fitted with a thermometer and a water cooled condenser. The ethoxylated amine was stirred and heated to 50° C. A stoichiometric amount of 4-hydroxy-3,5-ditertiary-butyldithiobenzoic acid (100 g) was then slowly added into the warm ethoxylated amine solution with stirring. The temperature was raised to 95° C. for 2 hours. The neutralization reaction was controlled with a portable pH meter. The addition of the acid was stopped at pH 7. After 2 hours of stirring at 95° C., the reaction product was cooled to room temperature and used without further purification.

EXAMPLE 2

Ball on Cylinder (BOC) friction tests were performed on ethoxylated (5) cocoalkylamine:dithiobenzoate from Example 1 in solvent 150N base oil using several concentrations of the additive. The BOC tests were performed using the experimental procedure described by S. Jahanmir and M. Beltzer in ASLE Transactions, 29, No. 3, p. 425 (1985) except that a force of 0.8 Newtons (1 Kg) rather than 4.9 Newtons was applied to a 12.5 mm steel ball in contact with a rotating steel cylinder having a 43.9 mm diameter. The cylinder rotates inside a cup containing a sufficient quantity of lubricating oil to cover 2 mm of the bottom of the cylinder. The cylinder was rotated at 0.25 rpm. The frictional force was continuously monitored by means of a load transducer. In the tests conducted, friction coefficients attained steady state values after 7 to 10 turns of the cylinder. Friction experiments were run at an oil temperature of 100° C. The results are shown in Table 1.

TABLE 1

| | | Coefficient of Friction | |
|---|---|---|---|
| Pt | Concentration (wt. %) in solvent 150N* base oil | Ethoxylated (5) cocoalkylamine:DTB | Primene** JMT:DTB |
| 1 | 0 | 0.37 | 0.37 |
| 2 | 0.05 | 0.121 | — |
| 3 | 0.1 | 0.107 | 0.3 |

TABLE 1-continued

| Pt | Concentration (wt. %) in solvent 150N* base oil | Coefficient of Friction: Ethoxylated (5) cocoalkylamine:DTB | Coefficient of Friction: Primene** JMT:DTB |
|---|---|---|---|
| 4 | 0.2 | — | — |
| 5 | 0.4 | 0.107 | — |
| 6 | 0.5 | — | 0.21 |
| 7 | 0.6 | 0.107 | — |
| 8 | 0.8 | 0.107 | 0.177 |

*S150 is a solvent extracted, dewaxed, hydrofined neutral lube base stock obtained from approved paraffinic crudes (viscosity, 32 cSt at 40° C., 150 Saybolt seconds)

**Primene JMT is a predominantly $C_{18}$ t-alkyl primary amine manufactured by Rohm & Haas.

The results shown in Table 1 demonstrate that the ethoxylated (5) cocoalkylamine:dithiobenzoate salt reduces the coefficient of friction by an additional 39.%% relative to an equivalent amount of non-ethoxylated salt, thus resulting in improved fuel economy.

What is claimed is:

1. A lubricating oil composition comprising:

(a) a major amount of lubricating oil basestock, and (b) A minor amount of an alkoxylated amine salt of a dihydrocarbyldithiobenzoic acid, said salt having the formula

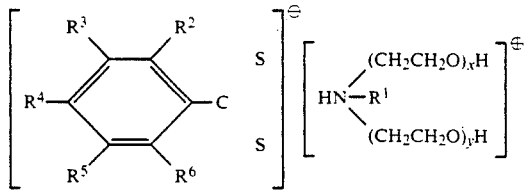

where $R^1$ is a hydrocarbyl group having from 2 to 22 carbon atoms, $R^2$, $R^3$, $R^4$, $R^5$ and $R^6$ are each independently hydrogen, a hydrocarbyl group containing from 1 to 24 carbon atoms or a hydroxy group with the proviso that at least one of $R^2$ to $R^5$ is a hydrocarbyl group, and x and y are each independently integers of from 1 to 15 with the proviso that the sum of x+y is from 2 to 20.

2. The composition of claim 1 wherein $R^1$ is alkyl or alkenyl of 6 to 18 carbon atoms.

3. The composition of claim 1 wherein the sum of x+y is from 2 to 15.

4. The composition of claim 1 wherein $R^4$ is hydroxy.

5. The composition of claim 1 wherein at least one of $R^2$ to $R^6$ is alkyl containing from 1 to 18 carbon atoms.

6. The composition of claim 1 wherein $R^3$ and $R^5$ are t-butyl.

7. The composition of claim 1 wherein the amount of salt is from about 0.1 to 5 wt. %, based on oil.

8. A method for improving friction reduction in an internal combustion engine which comprises operating the engine with a lubricating oil containing an effective to reduce friction of the amine salt of claim 1.

* * * * *